US005921177A

United States Patent [19]

Shin

[11] Patent Number: 5,921,177

[45] Date of Patent: Jul. 13, 1999

[54] PAD PRINTING MACHINE

[75] Inventor: Kyu Il Shin, Seoul, Rep. of Korea

[73] Assignee: John K. Shin, Montrose, Calif.

[21] Appl. No.: 09/090,197

[22] Filed: Jun. 4, 1998

[51] Int. Cl.[6] ..... B41F 17/00

[52] U.S. Cl. ..... 101/163; 101/41

[58] Field of Search ..... 101/35, 41, 42, 101/43, 44, 150, 163, 167, 169, 170

[56] References Cited

U.S. PATENT DOCUMENTS 4,060,031 11/1977 Philipp ..... 101/163
4,314,504 2/1982 Combeau ..... 101/41
4,615,266 10/1986 DeRoche et al. ..... 101/163
4,905,594 3/1990 Phillip et al. ..... 101/163

*Primary Examiner*—Edgar Burr
*Assistant Examiner*—Amanda B. Sandusky
*Attorney, Agent, or Firm*—Fulwider Patton Lee & Utecht, LLP

[57] ABSTRACT

This invention is to improve cam structure that can maintain precise moving time between a printing plate and a printing pad in a pad printer. Cam disk moving horizontally during the printing process and other cam disk moving vertically along the printing pad were combined to the double side of one cam in this pad printer of the invention. Therefore, the structure was simplified and miniaturized.

4 Claims, 10 Drawing Sheets

PAD PRINTING MACHINE

BACKGROUND OF THE INVENTION

1. Field of the Invention

This invention relates generally to a pad printer, and more particularly concerns improvements to the pad printer structure for maintaining precise timing between a printing plate and a printing pad.

2. Description of Related Art

Generally, the pad printer is the printing instrument that can transfer text, symbol or diagram (hereon, we will call it "text") engraved (or embossed, hereon, we will call it "engraved") in ink coated printing plate to a printing pad. So that in given time, print can go on wood, metal or plastic printing object that ink transfers from the printing pad.

One typical pad printer was described in detail in U.S. Pat. No. 4,905,594, as is illustrated in FIGS. 1 and 2. FIG. 1 is a front view of the typical pad printer, and FIG. 2 is a top view of the typical pad printer. As is shown in FIG. 1 and FIG. 2, a prime pin (14) is cross-connected between two facing support side walls (10), (11) in current pad printer. Side wall (10) is not shown in FIG. 1 for the sake of simplicity. The first lever (12), provided for moving the printing plate mounting member (24) and the printing plate (25) horizontally, and the second lever (13), provided for moving printing pad (27) vertically, are pivotally mounted to the prime pin (14) for rotation. Two cam disks (20), (21) and two supporting rollers (15) and (16) interacting with the cam disks are mounted to the first lever. The two cam disks (20), (21) will be described further below. The support rollers (15), (16) contact the corresponding surfaces ofthe cam disks (20), (21), respectively. As is best seen in FIG. 2, a cam shaft (19) is connected transversely between the supporting side walls (10) and (11), and two facing cam disks (20), (22) are mounted on the cam shaft (19). Therefore, while the cam shaft (19) rotates, the first lever (12) pivots the cam disks (20), (21); and proper selection of shapes of the cam disks (20), (21) permits for the control of the position of the first lever at any given time, and furthermore prevents undesirable movement of the first lever.

In the lower part of the first lever (12), a sliding plate groove (29) is connected to the print moving plate (24) by a bolt. This plate groove (29) provides flexibility required for pivoting movement of the first lever (12) to translate to linear movement of the print moving plate (24).

Additional cam disks (22), (23) are installed to rotate freely in the cam shaft (19). These cam disks (22), (23) interact with the corresponding supporting rollers (17), (18) mounted to the second lever (13). This allows the second lever (13) to be driven in a similar fashion as described for the first lever (12).

As described previously, if the right shape and the position of the cam disk (20–23) are selected, it is possible to precisely fix the interaction between the printing moving plate (24) and the moving phase of the printing pad (27). Therefore, the printing process can be accomplished accurately and smoothly.

Again referring to FIG. 1 and FIG. 2, a printing plate (25) is typically installed in the printing moving plate, and an ink container holding the printing ink (26). A connecting rod (30) is provided between the lever (13) and the printing pad (27), and a guide (28) is preferably provided to allow the printing pad (27) to move vertically.

When electricity is supplied to the prior art pad printer described above, a motor commences to drive the cam disks (20–23) that are connected to the motor by a belt, and the cam disks begin to rotate. When the cam disks (20–23) rotate, the first lever (12) pivots around the prime pin (14) due to interaction between one pair of the cam disks (20), (21) and one pair of the supporting rollers (15), (16), and subsequently, the print moving plate (24) moves horizontally, initially to left. As the print moving plate moves horizontally, ink from the ink container (26) coats the printing plate (25), and the ink coated plate moves horizontally on a bit further to the left.

Simultaneously, the second lever begins to pivot around the prime pin (14) due to interaction between one pair of additional cam disks (22), (23) and another pair of supporting rollers (17), (18). Accordingly, the connecting rod (30) commences to move vertically downward, and, due to the vertical movement of the connecting rod (30), the printing pad (27) connected to the rod also moves downward. Subsequently, the printing pad precisely contacts the printing plate (25), as is depicted in phantom with a dotted line, and ink coating the printing plate (25) is therefore transferred to the printing pad (27). At this point, the printing plate (25) moves horizontally to the right, while the printing pad (27) moves downward a certain further distance, and then an imprint is made on a printing object disposed under the printing pad.

After printing on the object is completed, the printing pad (27) is restored to its original position. Serial movement as described above can be easily accomplished depending on the shape and fixing position of the cam disks (20–23).

In prior art pad printer described above, two each of the sets of cam disks and the supporting rollers are required to move the printing plate horizontally, and another two each of the sets of cam disks and the supporting rollers are required to move the printing pad, leading to high manufacturing costs and excessive manufacturing time. Moreover, the volume and weight of the printing pad machine are increased, and printing position shifting problems can arise as a result of loosening of the axial connection of the cam disks to the prime pin after long usage, which can also result in a phase shift between the print moving plate and the printing pad.

SUMMARY OF THE INVENTION

Briefly, and in general terms, the present invention has been developed to overcome the problems of the prior art pad printer described above. The present invention reduces manufacturing costs and time, as well as volume and weight of the printing pad machine, by combining the cams of the printing plate and the printing pad.

The invention accordingly provides for an improved pad printer. Briefly, in the pad printer of the invention, a print moving plate is provided with a print plate and a first lever to cause the print plate to move back and forth. A printing pad prints on the object to be imprinted with ink transferred from coated print plate while the print moving plate moves forward. A second lever is also provided to move the printing pad up and down. In addition, in the present invention, the first supporting roller is mounted to the first lever, and the second supporting roller is mounted to the second lever. Also, on one side of the first supporting roller a guiding groove is provided for insertion of the first supporting roller, and on the other side of the second supporting roller another guiding groove is provided for insertion of the second supporting roller. A double sided cam carrying the guiding grooves is provided to cause the first and second supporting rollers to move back-and-forth and up-and-down, respectively, depending on the phase determined by two guiding grooves. With the back-and-forth and up-and-down movements of the first supporting roller and the second supporting roller, the first and second lever correspondingly move back-and-forth and up-and-down respectively, to result in printing on the object.

These and other aspects and advantages of the invention will become apparent from the following detailed description and the accompanying drawings, which illustrate by way of example the features of the invention.

EXPLANATION OF SYMBOLS IN THE FIGURES

10,11: Supporting Side Wall
12: First Lever
13: Secondary Lever
14: Prime Pin
15–18: Support Roller
19: Cam Shaft
20–23: Cam Disk
24: Printing Moving Plate
25: Printing Plate
26: Ink Container
27: Printing Pad
28: Guide
29: Oval Hole
30: Connecting Rod
100: Base
110,120: Supporting Side
130: Locking Supporter
132, 134: Operating Knob
140: Printing Object
200: Driving Motor
202: Motor Shaft
204: Driving Pulley
210: Belt
220: Supporting Bracket
230: Double Side Cam
232, 234: Guiding Groove
240: Cam Shaft
242: Side Moving Pulley
250: First Lever
252: First Rotating Axis
254: First Support Roller
256: Moving Hole
260 Second Lever
262: Second Rotating Axis
264: Second Support Roller
266: Moving Groove
270: Guide Groove
272: Guide Roller
274: Printing Moving Plate
276: Printing Plate
278: Secondary Connecting Material
280: Ink Container
282: Flange
284: Groove Fastening Container
290: Printing Pad
292: Connecting Rod
300: Ink Container Fastener
302: Operating Lever
304: LeverShaft
306: Cam
308: Compress Spring
310: Container Fastening Rod
312: Guide Groove

DETAILED DESCRIPTION OF THE PREFERRED EMBODIMENTS

Figure 1:
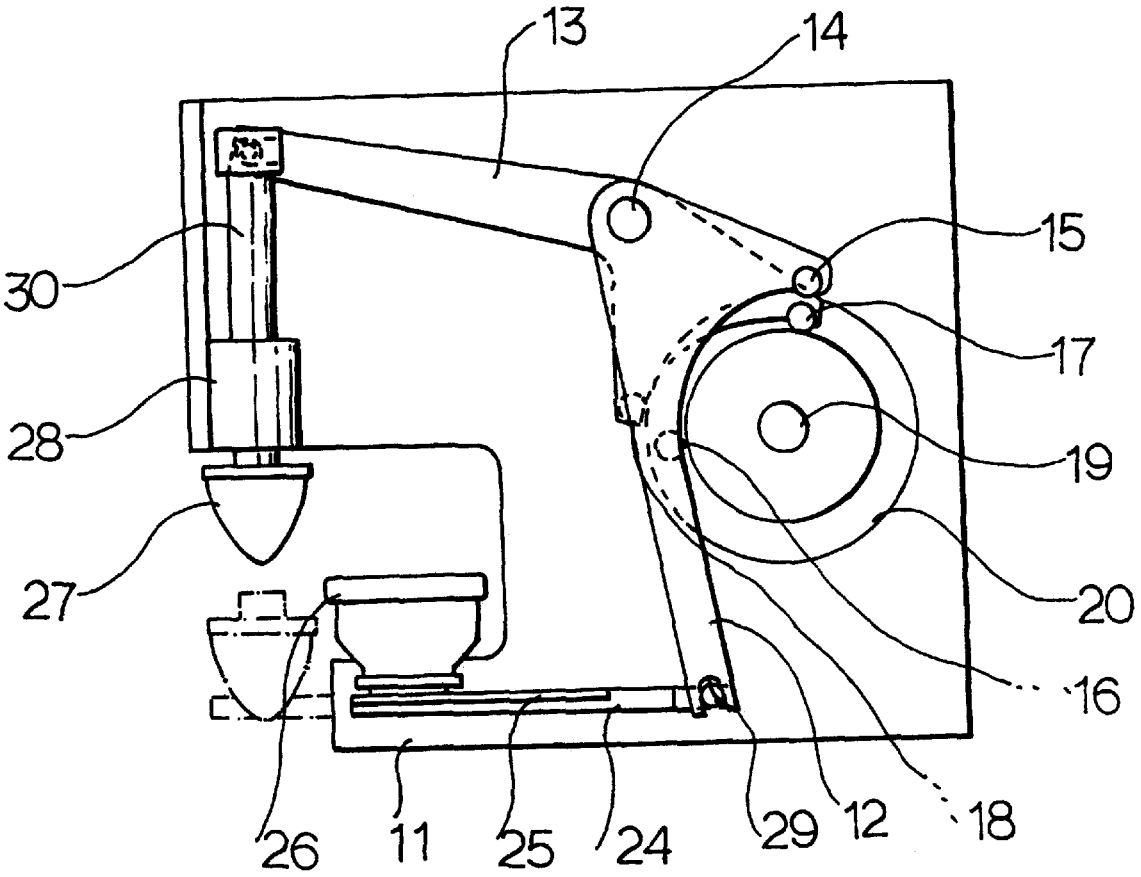
FIG. 1 is a front view of current pad printer with removed front side.
Figure 2:
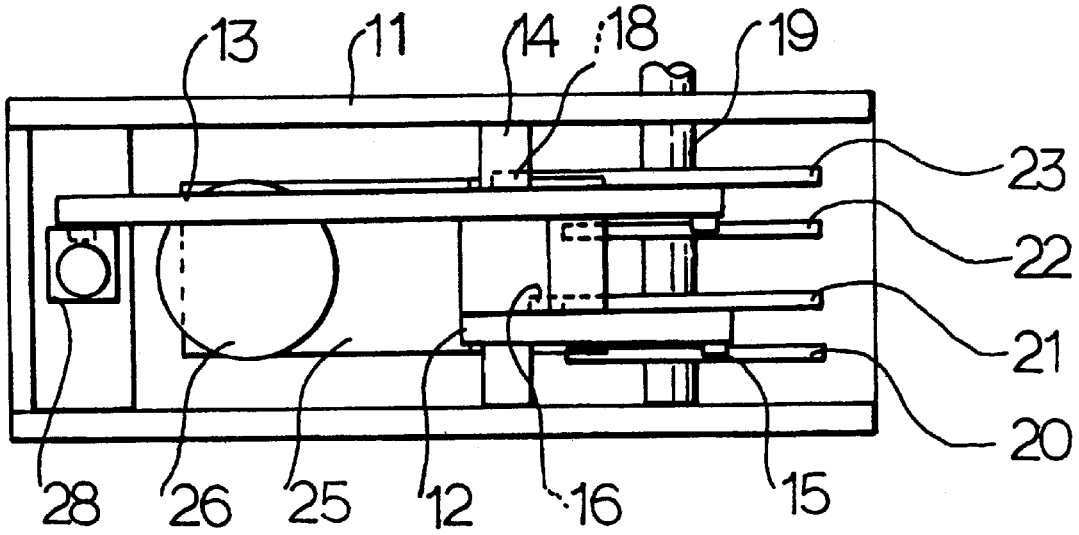
FIG. 2 is a top view of current pad printer.
Figure 3A:
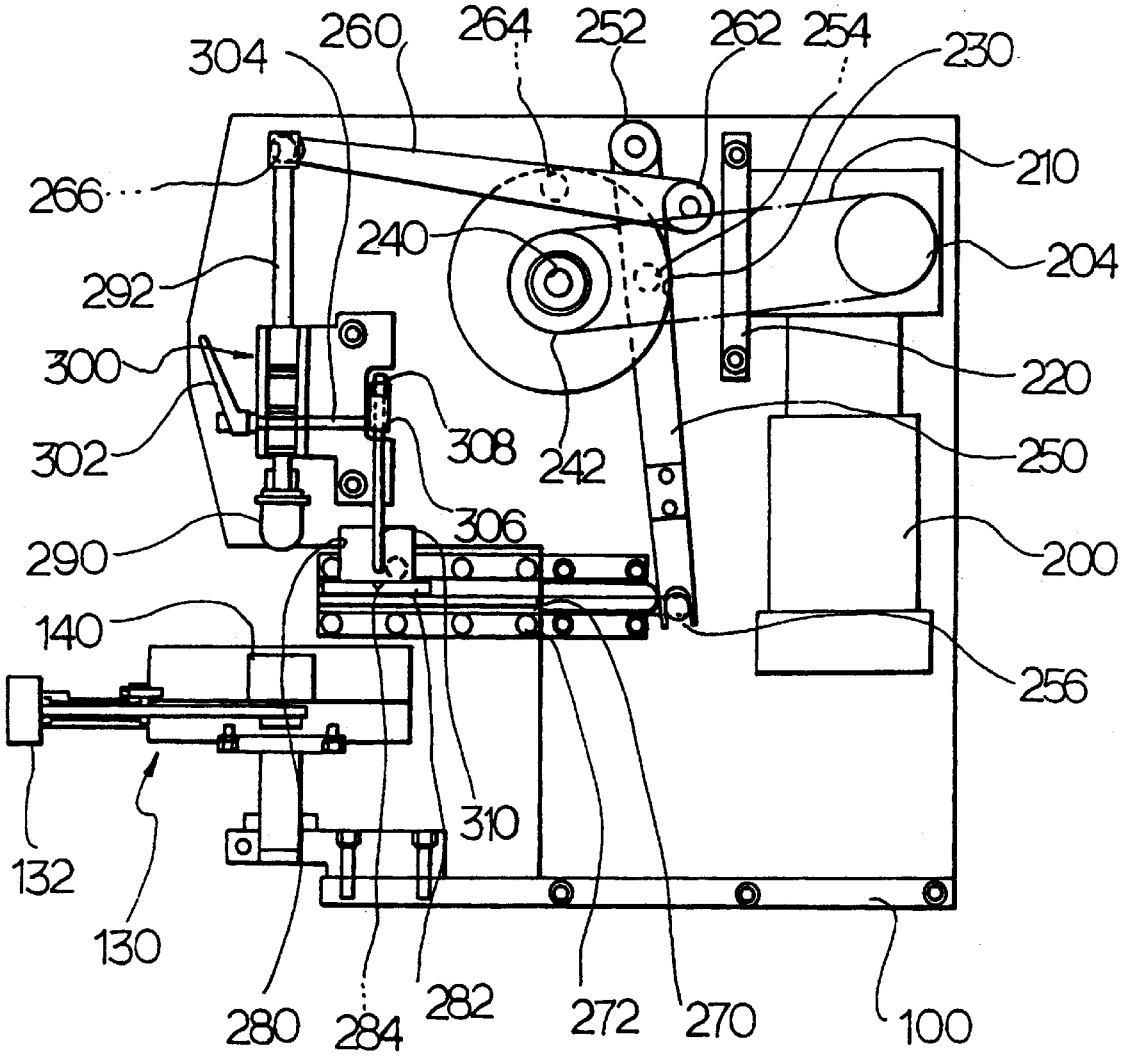
FIG. 3A to FIG. 3C is front views of a movement of the invented pad printer at different, critical times.
Figure 3B:
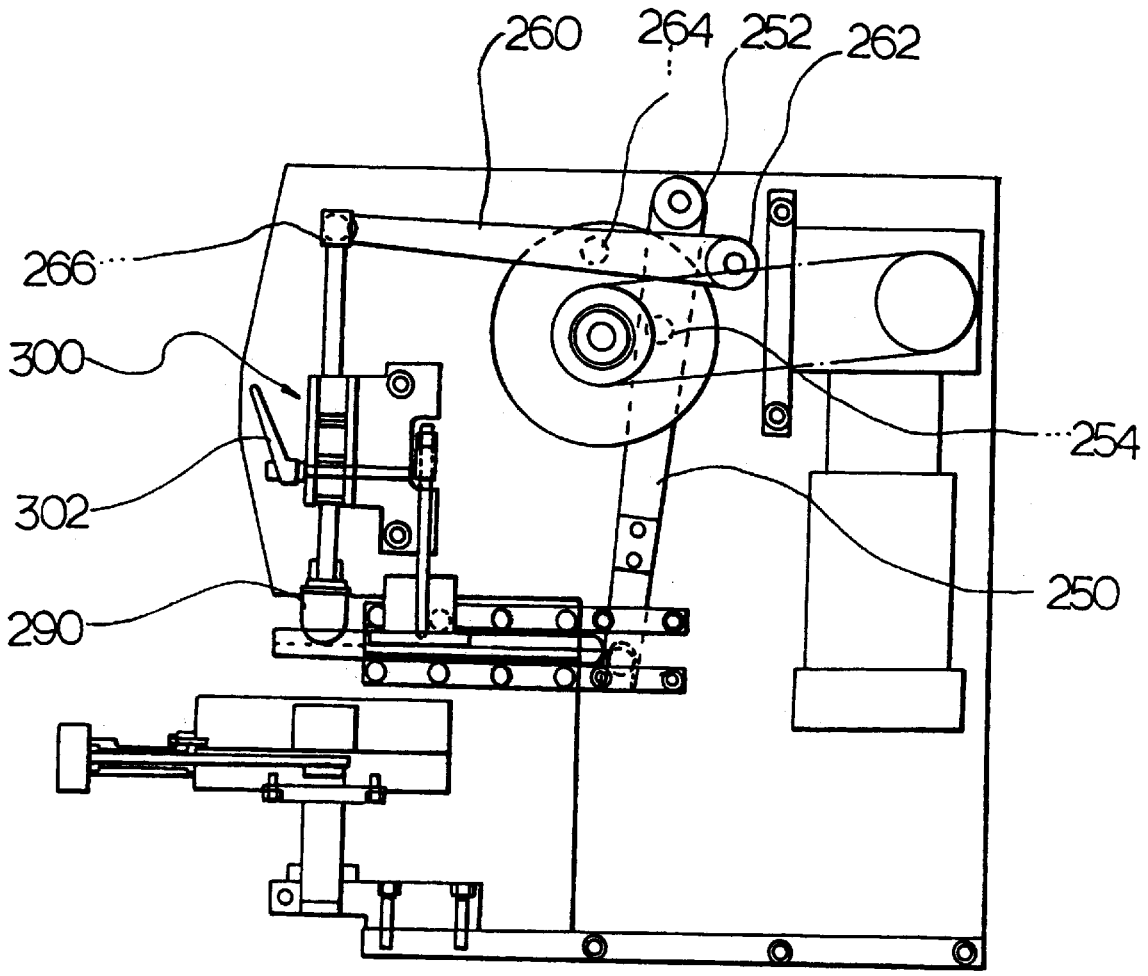
Figure 3C:
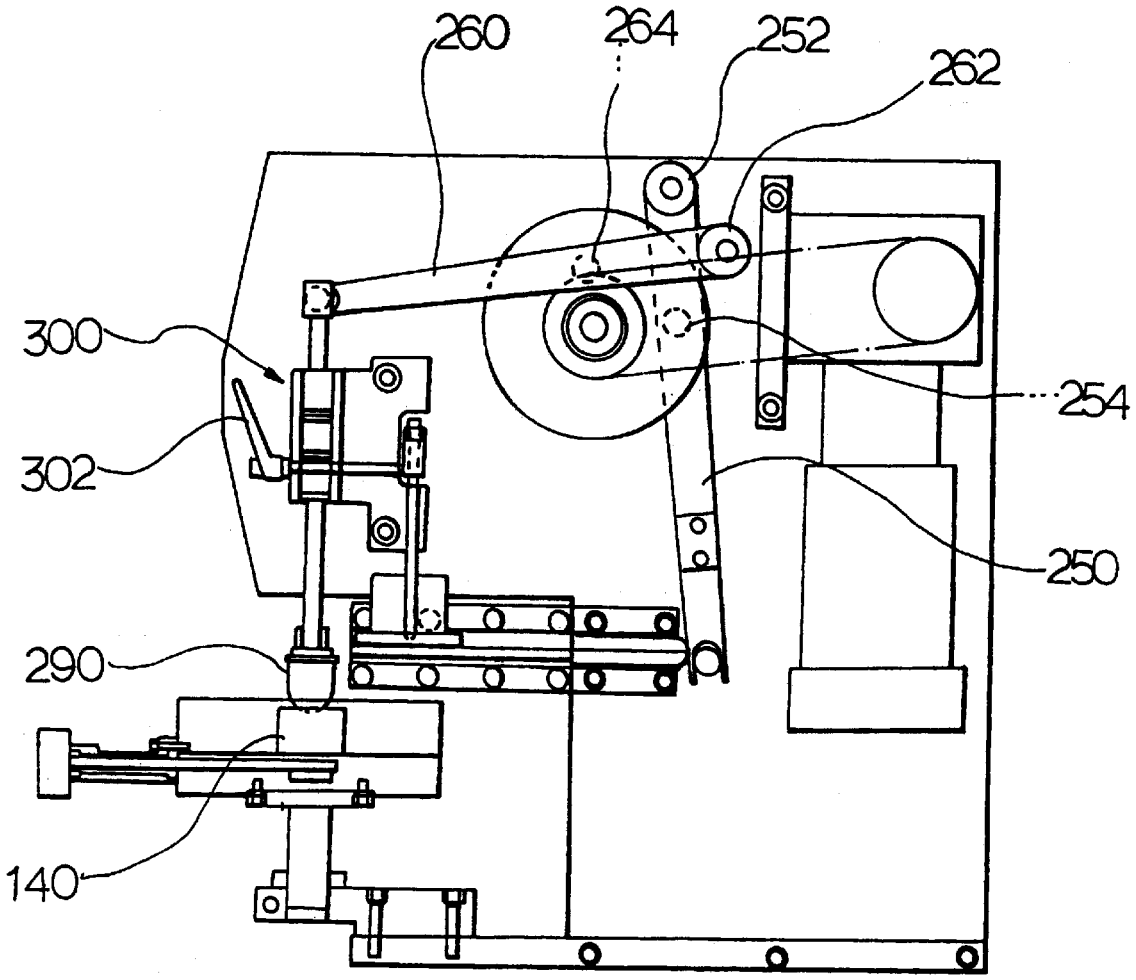
Figure 4:
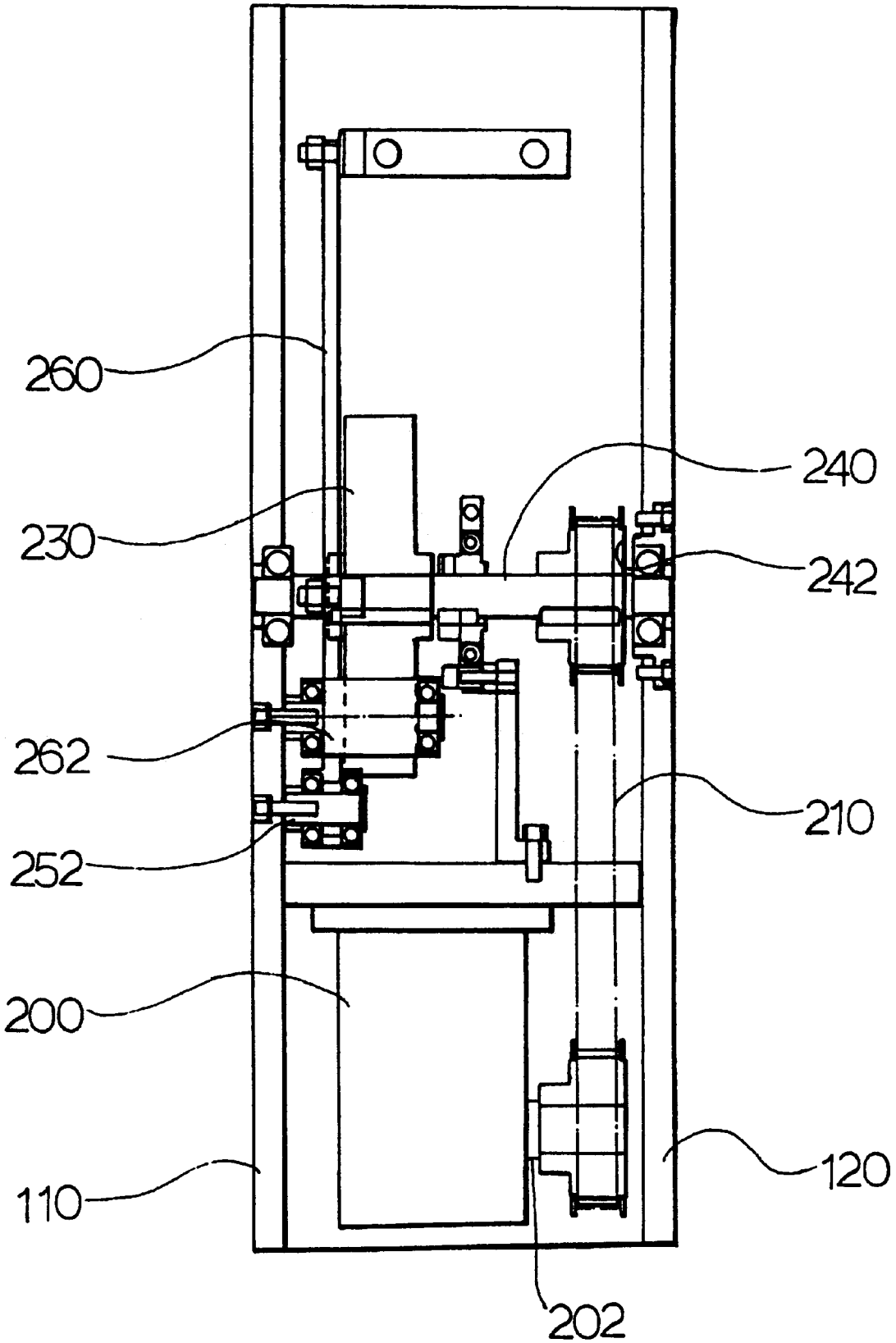
FIG. 4 is a top view of the pad printer prospected from FIG. 3.
Figure 5:
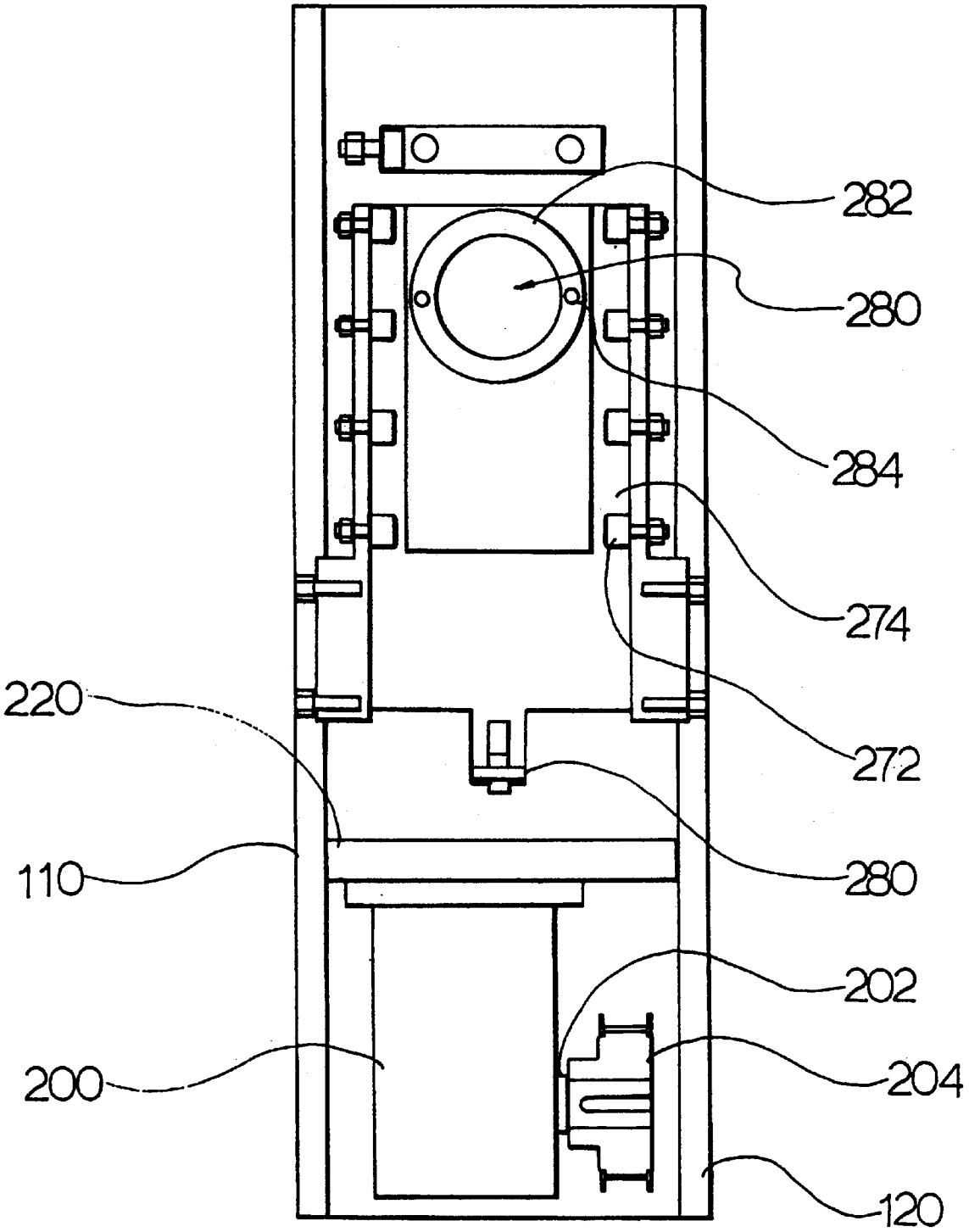
FIG. 5 is a top view of main parts from FIG. 1.
Figure 6:
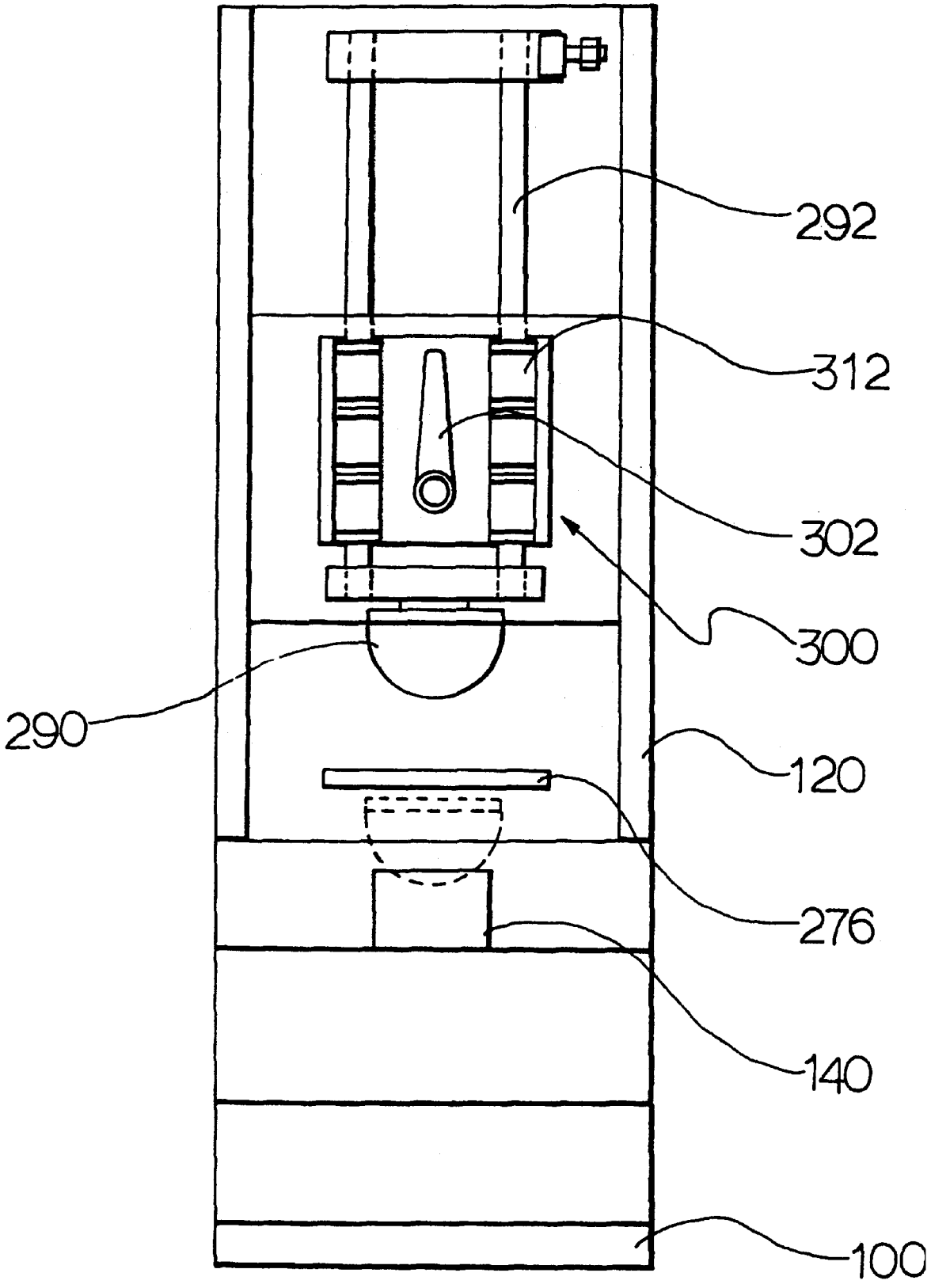
FIG. 6 is a side view of invented pad printer.
Figure 7:
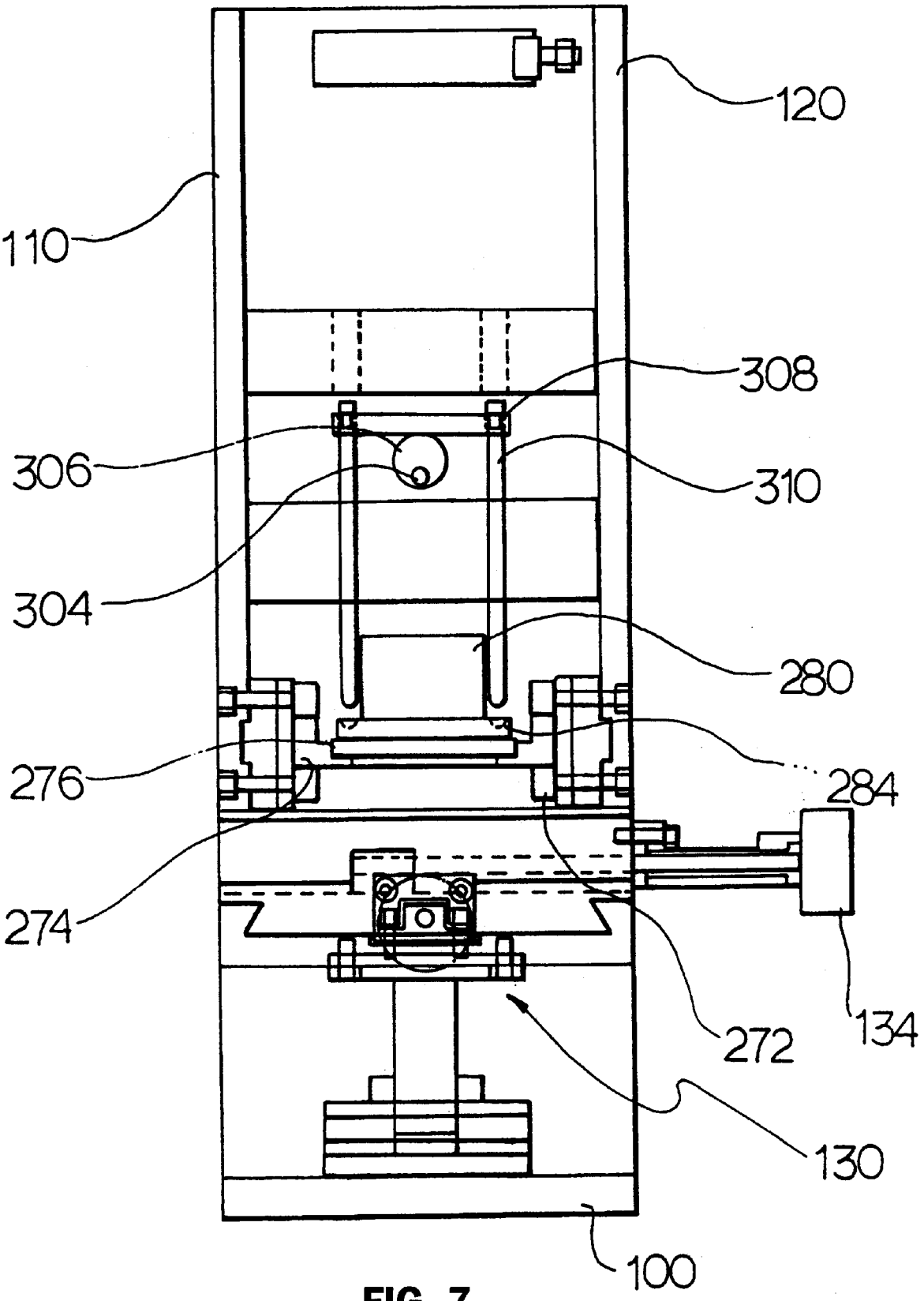
FIG. 7 is a side view of main parts from FIG. 1.

The pad printer will now be described in detail with reference to the accompanying drawings. FIG. 3A to FIG. 3C show front views illustrating the movement of elements of the pad printer at critical points during its operation. FIG. 4 is a top view of the pad printer shown in FIG. 3. FIG. 5 is a top view of the main parts shown in FIG. 1, and FIG. 6 is a side view of the pad printer of the invention. FIG. 7 is a side view of the main parts shown in FIG. 1.

First, as is depicted in FIG. 3 and FIG. 7, in the pad printer of the invention, a pair of facing supporting side walls (110), (120) are mounted to the top of base (100), and these supporting side walls (110), (120) support the main parts comprising the pad printer. At the middle of the supporting side walls (110), (120), a guiding groove (270) is provided, and several guide rollers (272) are installed at the top and bottom of the guiding groove (270). The print moving plate (274) with the print plate (276), engraved for example with printing text, is inserted in the guiding groove (270). Second, a secondary connecting member (278), such as a connecting pin of the printing plate, for example, is inserted in the slot (256) of the first lever to connect the end of the printing moving plate (274) to the first lever (250). The ink container (280) holding ink for the print plate (276) is located at the top of the print plate (276) and is secured under the container fastening rod (310), which will be described below. In the structure described previously, the moving plate (274) moves left and right in the view shown in FIGS. 3A to 3C, and is variously referred to hereinafter as back-and-forth movement or horizontal movement depending on the view. The guide roller (272) facilitates horizontal movement of the print moving plate (274), and moreover, prevents vertical movement.

The first lever (250) causes the print moving plate (274) to move horizontally. One end of the first lever (250), also referred to as the fixing side, is firmly mounted to the first rotating axis or shaft (252) which is connected transversely between the supporting side wall (110), (120), and the other end, also referred to as the flexible side, has a vertical slot (256) in which the second connecting member (278) is slidably mounted. As depicted in FIGS. 3A to 3C, the first supporting roller (254) is disposed at the rear of the first lever (250), and the body of the first supporting roller (254) is inserted into the guiding groove (232), also referred to as the front guide groove, which is engraved at the front of the double sided cam (230).

The second lever (260) causes the printing pad (290) to move vertically. One end of the second lever, also referred to as the fixing side, is firmly mounted to the second rotating axis or shaft (262). The second lever is connected transversely between the supporting side wall (110), (120) and the other side, also referred to as the flexible side, is connected to the connecting rod (292) extended from the printing pad (290), with some horizontal play. As depicted in FIGS. 3A to 3C, the second supporting roller (264) is disposed at the front of the second lever (260), and the body of the second supporting roller (264) is inserted into the guiding groove (234), also referred to as the rear guide groove, which is engraved at the rear of the double side cam (230). The printing pad (290) is typically made from silicone.

The double sided cam (230) causes the first lever (250) and the second lever (260) to move horizontally and vertically, respectively, by pivotal movement of the first (254) and second (264) supporting rollers. This double sided cam (230) is mounted to left side (as depicted in FIG. 4) of the rotating axis or cam shaft (240), which is horizontally connected between the tops of the supporting walls (110), (120). The cam shaft is driven by a side belt wheel or moving pulley (242) mounted at the right side (as depicted in FIG. 4) of cam shaft (240) which is connected by a belt (210) to a drive wheel or pulley (204), which is driven by geared motor (200), controlled to operate at a predetermined rpm. Since the drive pulley (204) and the side moving pulley (242) are connected by the belt (210), rotational power is transferred from the driving pulley (204) to the side moving pulley (242) to drive the cam shaft.

An ink container fastener (300) is installed at the left side of the supporting side walls (110), (120), as can best be seen in FIGS. 3Ato 3C, to help the printing pad (290) move smoothly and vertically, as well as to fix the ink container (280) at the correct position. The ink container fastener (300) is connected to an operating lever (302), and a cam is secured to the other side of operating lever (302), connected to an ink container fastener rod (310). When the operating lever is turned to a "fixed position", the ink container fastener (300) is secured by the compression spring (308), and the free side of the container fastening rod (310) is inserted into the container fixing groove (284) of the ink container (280). The ink container position could otherwise be out of alignment due to the vertical movement of the container fastening rod (310) by the cam (306) when the operating lever (302) is in the "off position". A guide groove (312) is provided in the fixing fastener (300) to guide vertical movement of the connecting rod (292).

Right under the print pad (290), there is a locking supporter (130) to fix the printing object (140), and the top of this locking supporter (130) is relatively lower than the top of the print plate (276). The operating knobs (132) and (134) are provided to secure the printing object (140) on the top of the locking supporter (130). The slot (256) and groove (266) are provided to smoothly translate the rotational movement of the first lever (250) and the second lever (260) to linear movement of the printing moving plate (274) and the connecting rod (292), respectively.

As previously described, the steps of the ink coating stage on the print plate (276) curved from the front guiding groove (232) and rear guiding groove (276) of the double side cam (230) are selected to perform precisely and sequentially. Also, transferring stage for coated ink on the printing plate (276) to the printing pad (290) and printing stage from the printing pad (290) on the printing object (14) with moving backward of the print plate (276) are selected to perform precisely and sequentially.

Figure 8:
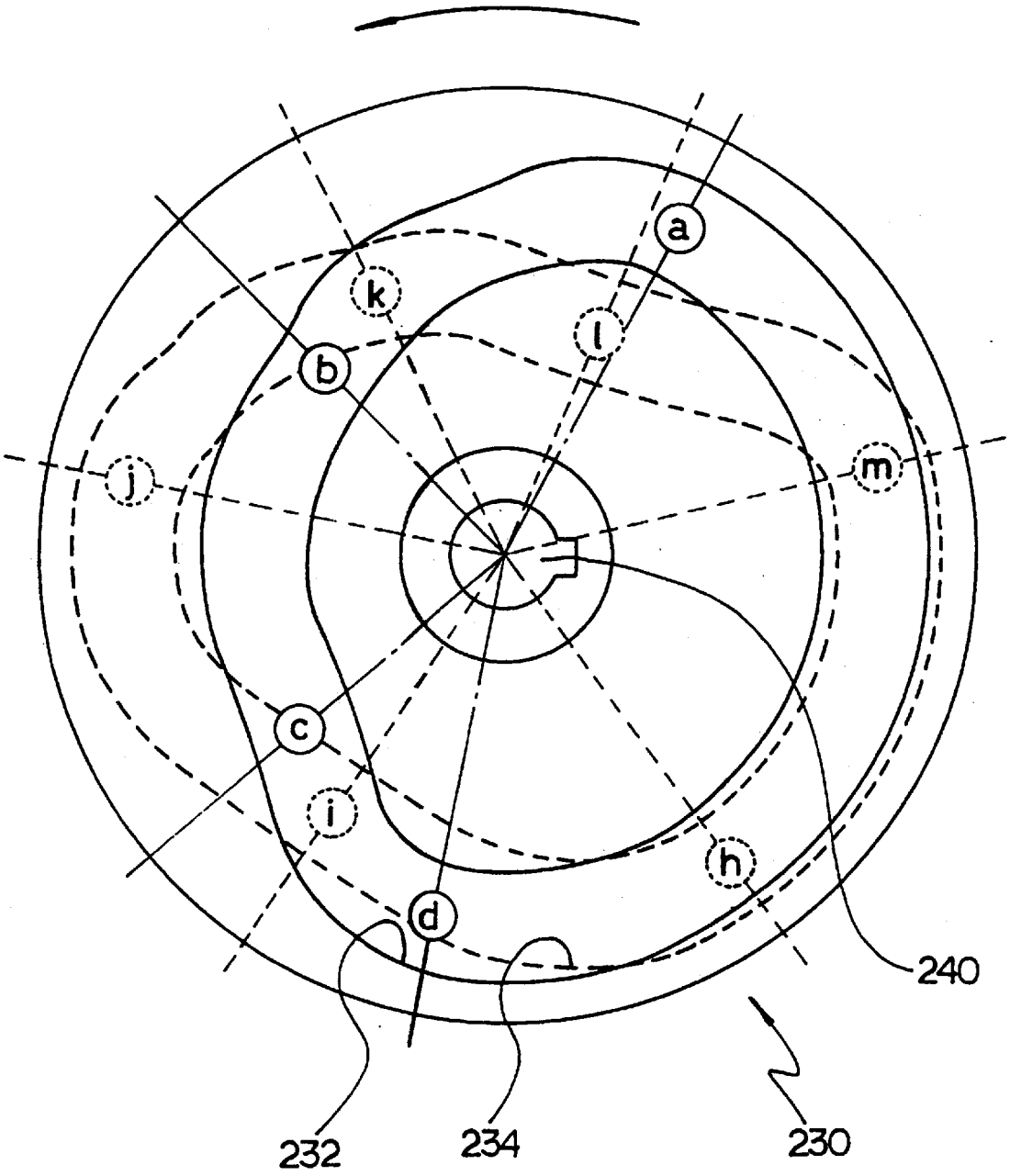
FIG. 8 is a front view of double side cap structure in the invention.

The operation of the pad printer of the invention will now be described in detail, with reference to FIG. 8, showing a front view of the structure of the double side cam in the invention. In FIG. 8, solid lines are used to represent the front guiding groove (232) in a front view of the double side cam (230), and the dotted lines represent the rear guiding groove (234) in a rear view of the double sided cam (230). An arrow represents rotating direction of the double sided cam (230). Letters (a) and (d) represent the relative positions of the front guide groove (232) and the first supporting roller (254) while double side cam (23) is rotating. Letters (h) and (m) represent relative positions of the rear guide groove (234) and the second supporting roller (264) which are synchronized with (a) and (d) respectively while the double sided cam is moving.

First, as a preparation for a print job, an operator should install the print plate (276) with engraved text on the print moving plate, and install the ink container (280) holding ink in a designated position, and then fasten the ink container (280) by moving the operating lever (302).

A conveyer belt or the like can be used to position the printing object (140) on the locking supporter (130) in each required printing period. After printing is completed, the printing object (140) is automatically removed from the locking supporter (130). Of course, positioning of the printing object (140) on the locking supporter (130) can also be performed manually using the operating knobs (132), (134).

Following these preparations for printing, the rotation shaft (202) of the driving motor (200) starts to rotate when the operator turns on the main switch. When the rotation shaft (202) of the driving motor rotates, the rotation force generated transfers to the driving pulley (204), belt (210), and side moving pulley (242) sequentially, and finally to the cam shaft (240), whereupon the double side cam (230) starts to rotate.

At the time when the double side cam (230) starts to rotate, the first supporting roller (254) is positioned at the approximate location of (a) on the front guiding groove (232), and the second supporting roller (264) is positioned at the approximate location of (b) on the rear guiding groove (234). With reference to FIG. 3A, the first lever (25) and the print moving plate (274) are moving backward and the second lever (260) and the printing pad (290) are moving upward.

When the cam shaft (240) keeps rotating as above, the radius of the front guiding groove (234) is gradually decreased to position (b) and then is constant from (b) to (c). Therefore, the print moving plate (274), as depicted at the FIG. 3B, keeps moving for a certain time. During the movement of the print moving plate (274), ink stored in the ink container (280) coats the print plate (276).

At the same time, the radius of the rear guiding groove (234) gradually decreases to position (i) then gradually increases from position (i) to position (j) again. As shown in FIG. 3B, the printing pad (290) contacts the print plate (276) installed on the print moving plate (274), gets ink from the coated print plate (276), and then begins to move upward.

Next, the radius of the front guiding groove (232) is increased gradually from position (c) to position (d) and becomes constant from (d) to its initial position (a). Therefore, the print moving plate (274) moves backward when the cam shaft (24) is rotating from position (c) to (d), and keeps its backward position when the cam shaft (24) is rotating from the position (d) to (a).

While the radius of the rear guiding groove (234) decreases rapidly in comparison to an angle from the position (i) to (k), the radius in comparison to the angle decreases gradually from the position (k) to (i). Therefore, the rotating angular velocity of the second supporting roller (264), in other words, the descending velocity of the printing pad (290), is changed from high speed to low speed before and after occupying position (k). The reason for the rear guiding groove (234) of the double side cam (23) to be formed as described above is to avoid ink spreading when the printing pad (290) is contacting the print object (14) at a high speed (or constant medium speed). In other words, the printing pad (290) descends at a relatively high speed when the double sided cam (23) is rotating from the position (i) to (k) and is descending at a relatively low speed when the double side cam is rotating from position (k) to (i). Thus, as shown in FIG. 3, the printing pad (290) is pushed on the top of the print object (140) at the final moment for the printing pad (290) to descend, and one cycle of the printing process on a printing object (14) is completed.

At the point when the process of printing on the print object (140) is completed, the radius is increased gradually from the rear guiding groove position (1) to position (m) and remains constant from the position (m) to the initial position (h). Thus, the printing pad (290) returns to initial raised position while the cam shaft (240) is rotating from the position (1) to the position (m) and it keeps moving upwardly when the cam shaft (240) is rotating from the position (m) to the initial position (h).

It should be recognized that the foregoing description is exemplary, and that modifications can be made based upon the foregoing principles of the invention. For example, it should be apparent that the first rotating shaft and second rotating shaft in above example need not be separate as described, and that the first and second levers can be installed on a shared rotating shaft.

It has thus been demonstrated that the pad printer of the invention described above can reduce manufacturing costs and time, and volume and weight of the machine by utilizing the combined cam of the print plate and the print pad. Additionally, there is no change of the printing position from long use, because there is no change in relative position of the front and rear guiding grooves.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. In a pad printing machine for printing on an object, the pad printing machine supporting a printing pad, a printing moving member and a printing plate mounted thereon for inking the printing pad, said printing plate being actuated for horizontal reciprocating movement by a first lever, said printing pad being actuated for vertical reciprocating movement by a second lever, said first and second levers respectively having corresponding first and second support rollers mounted thereon adapted to be driven by a cam to cause said reciprocating movements of said first and second levers, the improvement comprising:

a double sided cam mounted on a cam shaft driven for rotation, said double sided cam having a first guiding groove formed on a first side for receipt of the first support roller for controlling the horizontal and vertical movement of the first support roller, and a second guiding groove formed on a second side of the double sided cam for receipt of the second support roller for controlling the horizontal and vertical movement of the second support roller, whereby printing of the printing pad on the object is effected by the first and second levers being driven horizontally and vertically by the horizontal and vertical movement of the first and second supporting rollers.

2. The pad printing machine of claim 1, wherein said pad printing machine further comprises a pair of supporting side walls, a pair of opposed guiding grooves disposed in the supporting side walls, a plurality of guide rollers disposed in top and bottom rows of guide rollers along the top and bottom of the guiding grooves, and the printing moving member being disposed between said top and bottom rows of guide rollers, whereby said print moving plate will move smoothly as it reciprocates horizontally.

3. The pad printing machine of claim 1, wherein said printing pad moves at a relatively higher speed when the printing pad moves downward to transfer ink on the object.

4. The pad printing machine of claim 1, wherein the printing pad is formed of silicone.

* * * * *